US006315288B1

(12) United States Patent
Sugishima et al.

(10) Patent No.: US 6,315,288 B1
(45) Date of Patent: Nov. 13, 2001

(54) SHEET POST-PROCESSING APPARATUS

(75) Inventors: Yoshio Sugishima; Hiroshi Shimoyama; Keiji Okumura; Kazuhisa Kondoh; Sadahiro Matsuura; Tohru Tanjyoh; Tadakazu Okitsu, all of Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/267,675

(22) Filed: Mar. 15, 1999

(30) Foreign Application Priority Data

Mar. 18, 1998 (JP) ..... 10-068859
Mar. 18, 1998 (JP) ..... 10-068860

(51) Int. Cl.[7] ..... B42B 1/04

(52) U.S. Cl. ..... 271/303; 271/302; 270/58.11; 270/58.12; 270/58.13

(58) Field of Search ..... 270/58.11, 58.12, 270/58.13, 58.01, 58.07, 58.08, 58.09; 271/289, 288, 296, 302

(56) References Cited

U.S. PATENT DOCUMENTS 4,145,241 * 3/1979 Snellman et al. ..... 270/58.16 X
4,323,229 * 4/1982 Meus ..... 270/58.18
4,444,491 * 4/1984 Rinehart et al. ..... 270/58.14 X
4,473,425 * 9/1984 Baughman et al. ..... 270/58.08 X
4,564,185 * 1/1986 Hamlin et al. ..... 270/58.21 X
5,044,618 * 9/1991 Ettischer et al. ..... 270/58.08
5,106,069 * 4/1992 Wolf et al. ..... 270/58.05
5,112,034 * 5/1992 Uto et al. ..... 270/58.12
5,765,824 * 6/1998 Kawano et al. ..... 270/58.11

* cited by examiner

*Primary Examiner*—Christopher P. Ellis
*Assistant Examiner*—Patrick Mackey
(74) *Attorney, Agent, or Firm*—Smith, Gambrell & Russell LLP

(57) ABSTRACT

A sheet post-processing apparatus having a sheet tray, a sheet transportation path for guiding a sheet into the sheet tray, a bypass path bypassing a part of the sheet transportation path for guiding a sheet into the sheet tray, a post-processing mechanism for performing a post-processing operation on one set of sheets retained in the sheet tray, and a sheet transportation mechanism for feeding the sheet into the sheet tray. During the post-processing operation performed on the one set of sheets previously fed into the sheet tray, the first sheet of the next sheet set is once stopped in one of the transportation path and the bypass path, and the second sheet of the next sheet set is introduced into the other of the bypass path and the transportation path. Upon completion of the post-processing operation performed on the one sheet set, the first and second sheets of the next sheet set are fed into the sheet tray.

8 Claims, 8 Drawing Sheets

SHEET POST-PROCESSING APPARATUS

BACKGROUND OF THE INVENTION

1. Field of the Invention

The present invention relates to a sheet post-processing apparatus and, more specifically, to a sheet post-processing apparatus which performs a predetermined post-processing operation such as a stapling operation on sheets successively fed therein at a predetermined interval from an image forming apparatus such as a copying machine.

2. Description of Related Art

It is often desired to perform a stapling operation or a punching operation on a relatively large number of sheets each bearing an image transferred thereon by an image forming apparatus such as a copying machine or a printer.

In such a case, a sheet post-processing apparatus or a so-called finisher is conveniently used which automatically performs predetermined post-processing operations including the stapling operation and the punching operation.

An exemplary construction of the finisher is schematically illustrated in FIG. 7. The finisher 100 is detachably connected to a sheet discharging side of an image forming apparatus such as a copying machine, and includes an intermediate tray 101 which is capable of retaining therein a plurality of sheets P. Where a set of sheets successively discharged at a predetermined interval from the image forming apparatus is to be subjected to the stapling operation, the sheets P are once retained in the intermediate tray 101.

An introduction section 102 including introduction rollers 102*a* and an introduction guide 102*b* is provided in association with an upper portion of the intermediate tray 101. The sheets P discharged from the image forming apparatus are fed into the intermediate tray 101 via the introduction section 102.

The intermediate tray 101 is provided with a sheet receiver 103 which is movable along the intermediate tray 101. During the introduction of the sheets, the sheet receiver 103 is held on standby at a lower portion of the intermediate tray 101. The sheets P are successively fed from an upper portion of the finisher 100 onto the sheet receiver 103 along the intermediate tray 101 through the introduction section 102. Leading edges of the sheets P are supported by the sheet receiver 103.

A stapler 104 for performing the stapling operation, for example, is provided adjacent a standby position of the sheet receiver 103. The set of sheets P with their leading edges aligned (or registered) on the sheet receiver 103 is subjected to the stapling operation by the stapler 104. The sheet set subjected to the stapling operation is transported upward toward the upper portion of the finisher 100 by the sheet receiver 103, and discharged onto a sheet discharge tray 106 through sheet set discharging rollers 105.

The time required before the intermediate tray 101 is ready for acceptance of the next set of sheets upon completion of the stapling operation performed on the sheet set currently retained in the intermediate tray 101 is longer than the time interval at which the sheets P are successively introduced into the intermediate tray.

Therefore, where sheets P are fed at the predetermined time interval from the image forming apparatus, the first sheet of the next sheet set should be held on standby in a sheet transportation path 107 for some time until the intermediate tray 101 is ready for the acceptance of the next sheet set upon completion of the stapling operation.

In one conventional apparatus (not shown), having a greater length than the ordinary transportation path 107 is provided so that the first sheet of the next sheet set is transported through the longer transportation path and the second sheet of the next sheet set is transported through the ordinary transportation path 107 for elimination of the standby time.

In another conventional apparatus (not shown), two intermediate trays are provided so that, while sheets retained in one of the intermediate trays are subjected to a predetermined post-processing operation, sheets of the next sheet set are transported into the other intermediate tray for elimination of the standby time.

In the case of the first prior art where the second transportation path is provided which is longer than the ordinary transportation path, however, the second transportation path is complicated because of its greater length. Therefore, the apparatus is liable to cause a sheet jam, and has a difficulty in maintenance operations such as a sheet jam recovering operation.

In the case of the second prior art where the two intermediate trays are provided, the apparatus has a correspondingly complicated construction and increased size.

On the other hand, where a positional relationship between the standby position of the sheet receiver 103 and the introduction section 102 is not proper with respect to the length of a sheet P, an event as shown in FIG. 8 may occur. More specifically, a sheet P2 slips into the rear side (the left side as seen in FIG. 8) of a sheet P1 previously fed into the intermediate tray 101.

Particularly, a sheet has a great warpage immediately after being heated for image fixation, so that the slip-in of the sheet is more liable to occur. If the slip-in of the sheet occurs, sheets to be discharged are arranged in a different collating order from an order in which the sheets have been fed from the copying machine.

The sheets transported into the intermediate tray 101 may have different lengths, as measured with respect to the transportation direction, depending upon the sheet type (A size, B size). Therefore, the conventional sheet post-processing apparatus is adapted to variably adjust the positions of the introduction section 102 and the sheet receiver 103 and the standby position of the stapler 104 in accordance with the sheet type. Thus, the positional relationship between the sheet receiver 103 and the introduction section 102 is optimized.

However, driver systems and the like are required for moving the introduction section 102, the stapler 104 and the like in accordance with the sheet type. Therefore, the apparatus has a more complicated construction and a greater size.

SUMMARY OF THE INVENTION

It is a first object of the present invention to provide a sheet post-processing apparatus which has a simple and compact construction for reduction of a standby time between processing of one sheet set and processing of the next sheet set.

It is a second object of the present invention to provide a sheet post-processing apparatus which is capable of keeping the collating order of sheets with a simple and compact construction.

In accordance with a first aspect of the present invention, there is provided a sheet post-processing apparatus which comprises a sheet tray capable of retaining therein a plurality of sheets, and a transportation path for feeding a sheet to the sheet tray, the transportation path having a bypass path bypassing at least part of the transportation path. During a predetermined post-processing operation performed on one set of sheets previously supplied into the sheet tray, the first sheet of the next sheet set is once stopped within the transportation path or the bypass path, and the second sheet of the next sheet set is fed into the bypass path or the transportation path. Then, the first and second sheets of the next sheet set are fed into the sheet tray upon completion of the predetermined post-processing operation performed on the one set of sheets.

With this simple and compact construction, the standby time between the processing of the one sheet set and the processing of the nest sheet set can be reduced.

In accordance with a second aspect of the present invention, there is provided a sheet post-processing apparatus which comprises a sheet tray generally vertically disposed and capable of retaining therein a plurality of sheets, and is adapted to perform a predetermined sheet processing operation on a plurality of sheets with edges thereof registered adjacent a lower portion of the sheet tray (on a bottom of the tray or on a sheet receiver separately provided adjacent the lower portion of the tray). The apparatus is further adapted to introduce a sheet into the sheet tray from one of a plurality of sheet feeding positions which are located as corresponding to lengths of a plurality of different types of sheets as measured with respect to a sheet transportation direction.

With this arrangement, a sheet is introduced into the sheet tray from an appropriate sheet feeding position in accordance with the length of the sheet. This obviates the need for providing a stapler driver or the like for prevention of the slip-in of the sheet. Therefore, the apparatus has a reduced size and a simplified construction.

The foregoing and other objects, features and effects of the present invention will become more apparent from the following description of the preferred embodiments with reference to the attached drawings.

DESCRIPTION OF THE PREFERRED EMBODIMENTS

Embodiments to be described below are directed to applications of the sheet post-processing apparatus of the present invention to finishers for a copying machine. It should be understood, however, that the embodiments do not limit any of the technical aspects of the present invention.

Figure 1:
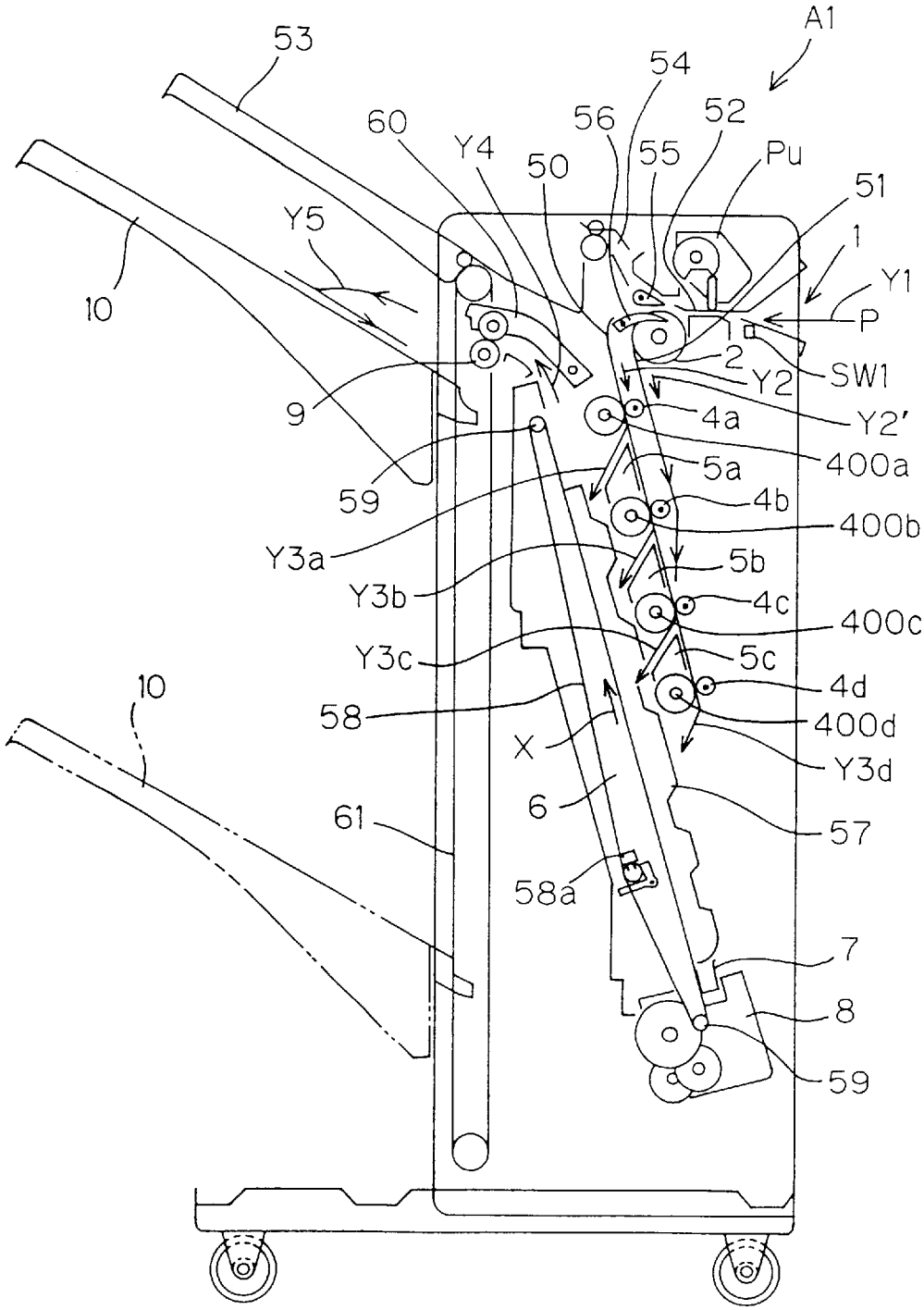
FIG. 1 is a sectional view schematically illustrating the overall construction of a finisher according to one embodiment of the present invention.
Figure 2:
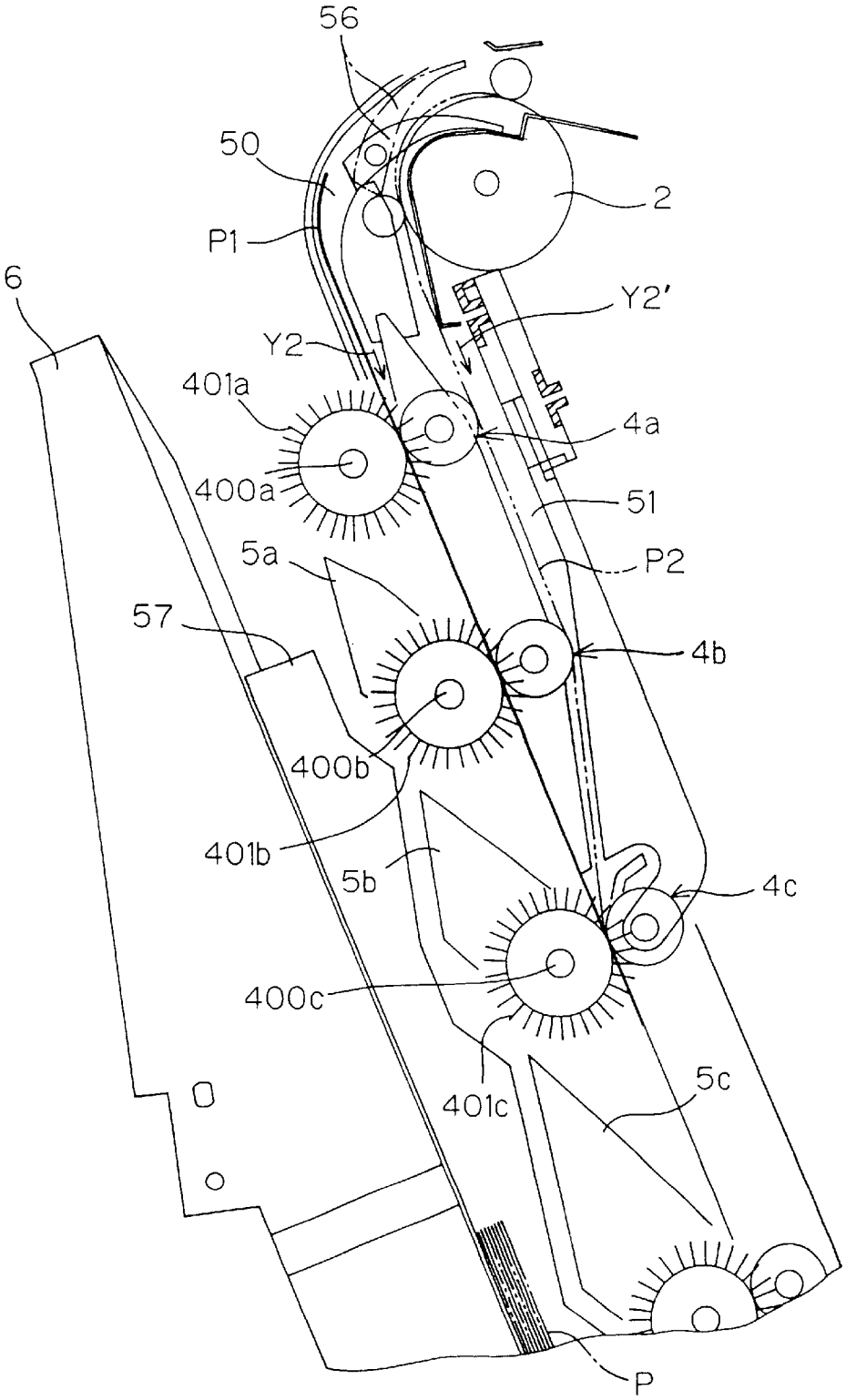
FIG. 2 is an enlarged sectional view illustrating an arrangement around an intermediate tray of the finisher.

FIG. 1 is a diagram schematically illustrating the overall construction of a finisher according to one embodiment of the present invention, and FIG. 2 is a diagram illustrating major portions of the finisher.

The finisher is adapted to perform a predetermined post-processing operation such as a punching operation or a stapling operation on sheets successively fed therein from a main body of a copying machine after image fixation, and then discharge the sheets.

As shown in FIG. 1, the finisher A1 according to the embodiment includes an intermediate tray 6 (sheet tray) capable of retaining therein a plurality of sheets, a sheet receiver 7 held on standby below the intermediate tray 6 for supporting leading edges of the sheets retained in the intermediate tray 6, and a stapler 8 for performing the stapling operation on the sheets supported at their leading edges by the sheet receiver 7. Where the stapling operation is to be performed on sheets P successively fed from the copying machine (not shown) at a predetermined time interval, the sheets P are once retained in the intermediate tray 6. The intermediate tray 6 is slightly inclined with respect to a vertical line for saving an installation space of the finisher A1.

The finisher A1 is detachably connectable to a sheet discharging side of the copying machine. The sheets P successively transported from the direction of an arrow Y1 are fed into the intermediate tray 6 through a transportation passage 50 (corresponding to "transportation path").

As shown in FIG. 2, the finisher A1 includes a bypass passage 51 (corresponding to "bypass path") bypassing a part of the transportation passage 50. During the stapling operation performed on one set of sheets P previously fed into the intermediate tray 6, the first sheet of the next sheet set is once stopped in the transportation passage 50. The second sheet P2 of the next sheet set is transported into the bypass passage 51. Upon completion of the stapling operation performed on the one set of sheets P, the first and second sheets Pl and P2 of the next sheet set are fed into the intermediate tray 6 with their leading edges aligned.

Further, the finisher A1 has pivotal deflector claws 5*a*, 5*b*, 5*c* each defining part of the transportation passage 50 for transporting a sheet into the intermediate tray 6. These deflector claws 5*a*, 5*b*, 5*c* are respectively located apart from the sheet receiver 7 on standby by different distances which correspond to lengths of a plurality of different types of sheets as measured with respect to the transportation direction. By pivoting the deflector claws 5*a*, 5*b*, 5*c*, the sheet transportation direction can be changed in the transportation passage 50. Thus, the sheet can be fed into the intermediate tray 6 from an appropriate sheet feeding position in accordance with the length of the sheet.

Next, the finisher A1 will be described in greater detail.

Sheets P successively discharged from the copying machine at a predetermined interval after image transfer are introduced into the finisher A1 from a sheet feeding port 1 with their image-carrying faces up or down as seen in FIG. 1.

An introduction switch SW1 for detecting an introduced sheet P and a punching unit Pu for performing the punching operation on the introduced sheet are provided immediately downstream of the sheet feeding port 1 with respect to the sheet transportation direction.

The introduction switch SW1 is comprised of a photo switch of reflective type, for example. When a light beam from the introduction switch SW1 is reflected on the introduced sheet P, the introduction switch SW1 outputs a sheet detection signal indicative of the detection of the sheet P. The detection of the leading edge of the sheet P is based on transition from a state where the sheet detection signal is not outputted to a state where the signal is outputted. Conversely, the trailing edge of the sheet is detected by detecting transition from the signal output state to the signal non-output state.

The punching unit Pu includes a solenoid, a clutch and the like, and performs the punching operation by projecting and retracting punches and edge stoppers thereof with respect to a transportation passage 52 in response to the sheet detection signal or the like.

The transportation passage 52 connected to the sheet feeding port 1 is further connected to a transportation passage 54 for transporting a sheet toward a non-sort tray 53 and to the transportation passage 50 for transporting a sheet toward the intermediate tray 6. The sheet P fed from the copying machine is transported into either of the transportation passages 50 and 54 by a pivotal deflector claw 55.

A sheet P guided into the transportation passage 54 by the deflector claw 55 is discharged into the non-sort tray 53 with its upper face being the same as that which faced upward when it was discharged from the copying machine.

On the other hand, a sheet guided into the transportation passage 50 by the deflector claw 55 is transported into the intermediate tray 6 which is slightly inclined with respect to the vertical line.

A deflector claw 56 pivotal between positions respectively indicated by a solid line and a dot-and-dash line in FIG. 2 is provided upstream of the transportation passage 50 with respect to the sheet transportation direction. When the deflector claw 56 is located in the solid line position, the sheet P is transported through the transportation passage 50 in the direction of an arrow Y2. Conversely, when the deflector claw 56 is located in the dot-and-dash line position, the sheet is transported through the bypass passage 51 provided parallel to the transportation passage 50 in the direction of an arrow Y2'.

Four pairs of deflector rollers 4 (4*a*, 4*b*, 4*c*, 4*d*) and the three deflector claws 5 (5*a*, 5*b*, 5*c*) are arranged along the sheet transportation direction downstream of the deflector claw 56 with respect to the sheet transportation direction.

Figure 3:
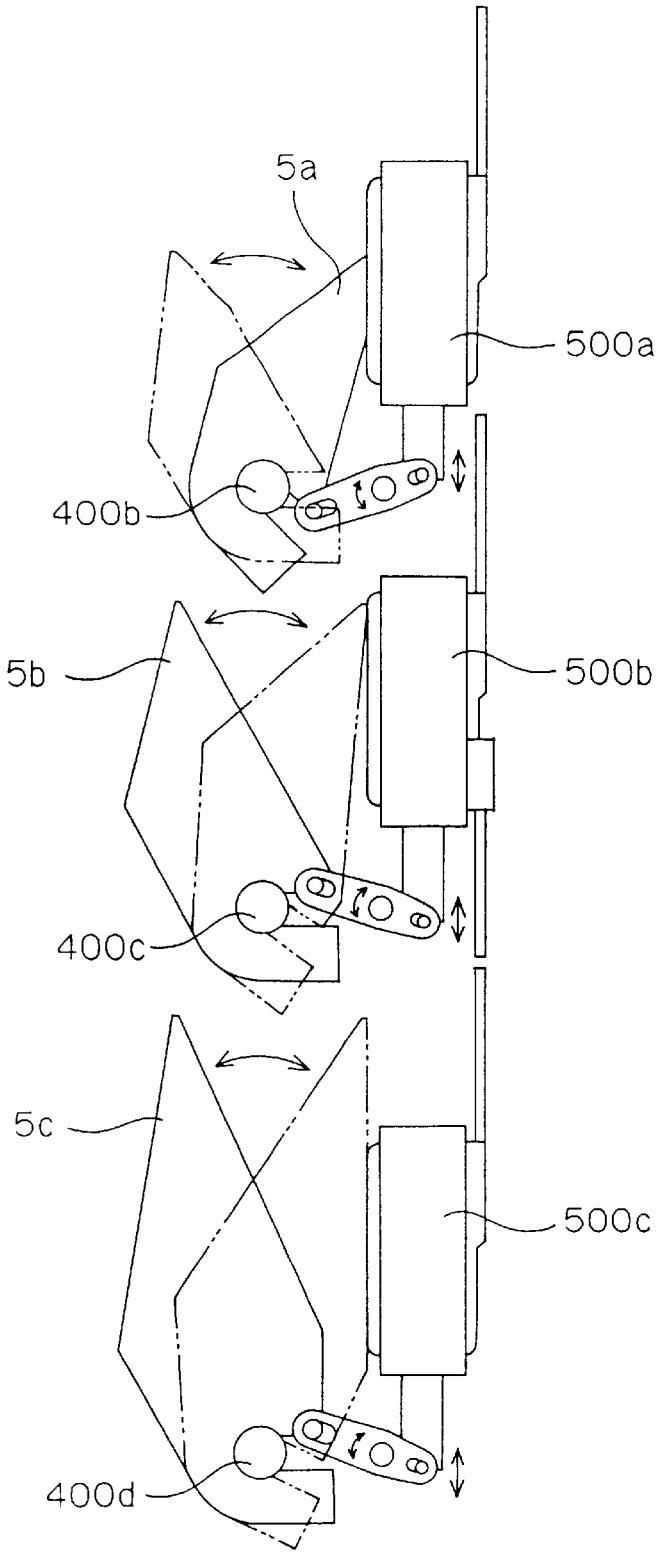
FIG. 3 is a detailed view of deflector claws provided in the finisher.

The deflector claws 5 are each pivotal between positions indicated by a solid line and a dot-and-dash line in FIG. 3. By pivoting the deflector claws 5, the sheet transportation direction (transportation path) in the transportation passage 50 is switched between a direction toward the intermediate tray 6 and a direction parallel to the intermediate tray 6. Thus, the sheet P is transported into the intermediate tray 6 from one of directions indicated by arrows Y3*a*, Y3*b*, Y3*c* and Y3*d*.

FIG. 3 illustrates the deflector claws 5 in detail.

The deflector claws 5 (5*a*, 5*b*, 5*c*) are respectively attached to shafts 400 (400*b*, 400*c*, 400*d*) so as to be pivotal thereabout between positions indicated by dot-and-dash lines and positions indicated by solid lines in FIG. 3. The deflector claws 5 are presently located in the solid line positions.

The deflector claws 5 are respectively linked to lockup-type solenoids 500 (500*a*, 500*b*, 500*c*). The lockup-type solenoids 500 move in one direction to pivot the corresponding deflector claws 5.

Pivot positions of the deflector claws 5 are determined in accordance with the length of the sheet P as measured with respect to the transportation direction at mode standby immediately after the startup. In the case of an A4 sheet, for example, none of the solenoids 500 are actuated, whereby the sheet is transported into the intermediate tray 6 from the direction of the arrow Y3*d* (See FIG. 1). In the case of a A3 sheet, only the solenoid 500*a* is actuated (actuation of the other solenoids may be done, but is meaningless), whereby the sheet is transported into the intermediate tray 6 from the direction of the arrow Y3*a* (See FIG. 1).

Figure 4:
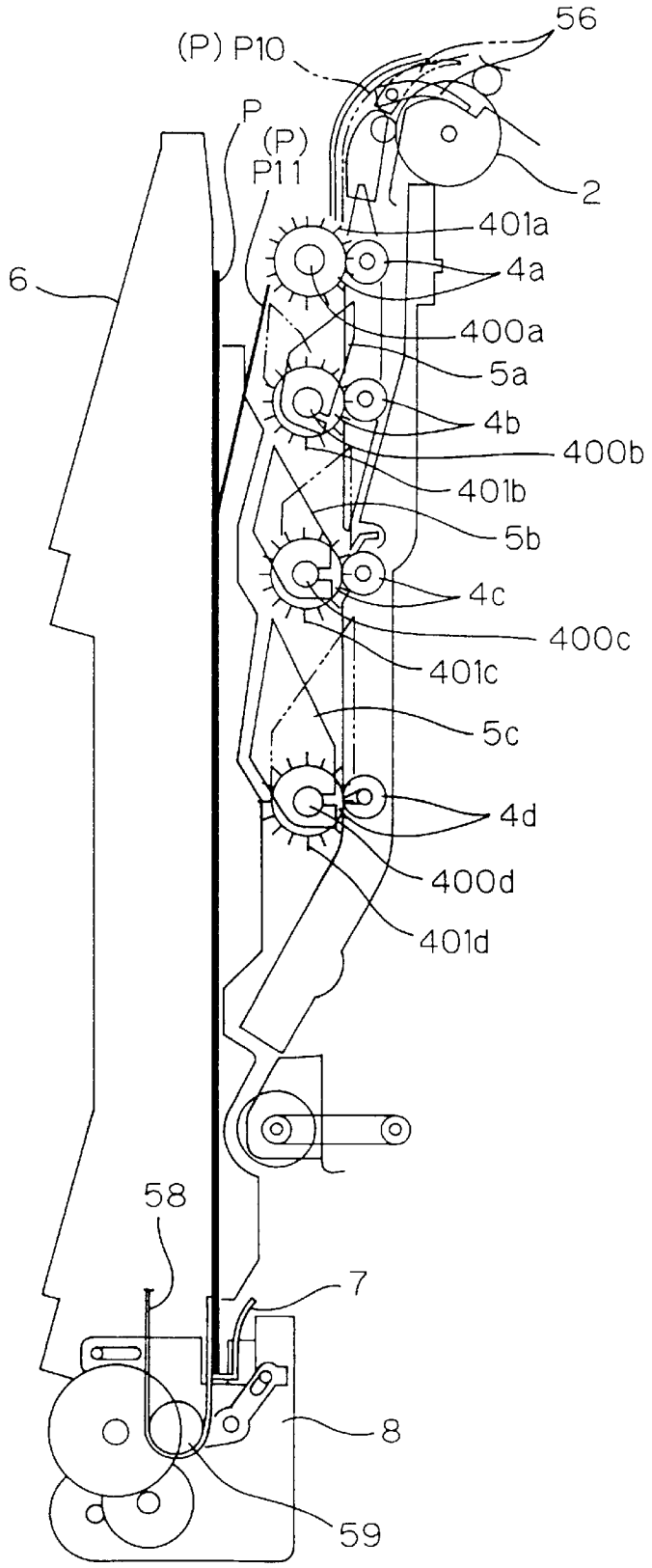
FIG. 4 is a diagram for explaining states of sheets fed into the finisher.

FIG. 4 is a diagram for explaining the transportation of the A3 sheet into the intermediate tray 6 from the direction of the arrow Y3*a*. The deflector claws 5 are respectively located apart from the standby position of the sheet receiver 7 by different distances which correspond to lengths of a plurality of different types of sheets as measured with respect to the transportation direction. With the leading edge of a sheet abutting against the sheet receiver 7, the trailing edge of the sheet is located at the same level as one of the deflector claws 5 corresponding to the size of the sheet.

Further, the finisher A1 is provided with brush rollers 401 (401*a*, 401*b*, 401*c*, 401*d*) supported rotatably about the same shafts 400 (400*a*, 400*b*, 400*c*, 400*d*) as the deflector rollers 4. These brush rollers 401 each corotate with the corresponding shaft 400 to prevent the trailing edge (upper edge) of the sheet P fed into the intermediate tray 6 from staying adjacent a nip position of the corresponding deflector roller pair 4.

Particularly, the sheet fed from the copying machine has been heated for the image transfer and, hence, has a great warpage. Therefore, the trailing edge of the sheet P is liable to stay adjacent the nip position of the deflector roller pair 4.

The brush rollers 401 are each adapted to rotate in contact with the sheet P being fed into the intermediate tray 6 from the direction indicated by the corresponding one of the arrows Y3 (See FIG. 1). Thus, the brush roller 401 moves the trailing edge (upper edge) of the sheet P in its rotating direction away from the nip position of the deflector roller pair 4.

A sheet P11 (P) shown in FIG. 4, for example, is in a state immediately after the trailing edge (upper edge) thereof has been moved away by the brush roller 401*a*.

Thus, a sheet is prevented from slipping into the rear side of a sheet previously fed into the intermediate tray 6, so that the sheet collating order will never be changed.

Figure 5:
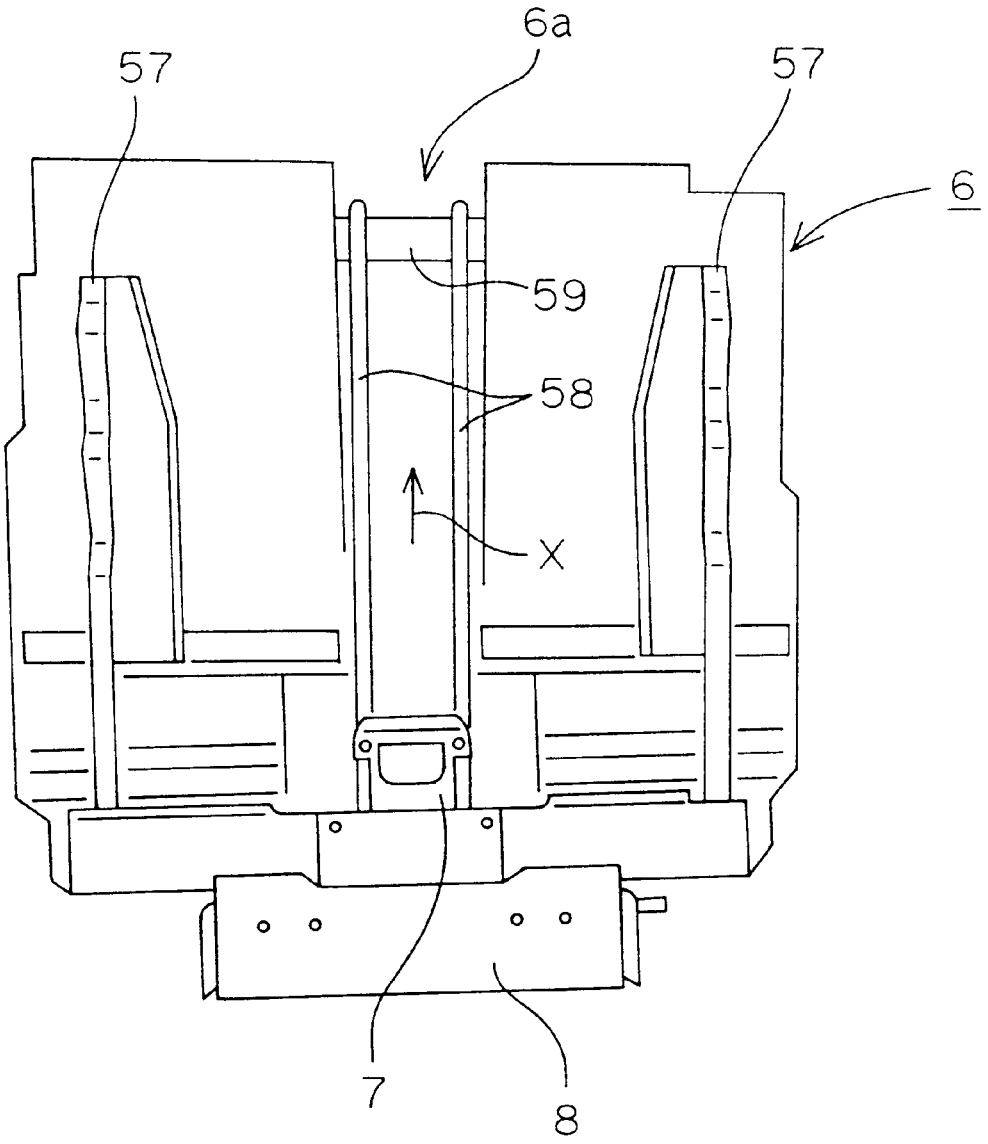
FIG. 5 is a diagram illustrating an arrangement around the intermediate tray.

As best shown in FIG. 5, the intermediate tray 6 is provided with a pair of cursors 57 reciprocally movable perpendicularly to the sheet transportation direction (transversely of the sheet). Each sheet introduced into the transportation passage 50 is transported between the cursors 57 within the intermediate tray 6.

About 50sheets, for example, can be retained in the intermediate tray 6, and lateral edges of the sheets are aligned by the cursors 57. Then, the leading edges of the sheets are stapled by the stapler 8.

Upon completion of the stapling operation, the stack of sheets with their leading edges stapled is supported by the sheet receiver 7 and transported toward a discharge tray 10.

The sheet receiver 7 is attached to a pair of endless belts 58 disposed along the intermediate tray 6. By travel of the endless belts 58, the sheet receiver 7 is moved upward in the direction of an arrow X toward the discharge tray 10.

The intermediate tray 6 is split generally vertically as shown in FIG. 5 by a split portion 6*a* extending vertically. The endless belts 58 are stretched between belt rollers 59 as extending along the split portion 6*a*. The endless belts 58 travel in the direction of the arrow X to move the sheet receiver 7 fixed on a surface of the endless belts 58.

During the introduction of the sheets, the sheet receiver 7 is held on standby below the intermediate tray 6 to support the leading edges (lower edges) of the sheets P fed into the intermediate tray 6.

The standby position of the sheet receiver 7 is properly set by a transportation belt home sensor 58*a* (See FIG. 1) provided adjacent the endless belts 58. The transportation belt home sensor 58*a* may be comprised of a photo sensor of transmissive type, for example. The stapler 8 is provided adjacent the standby position of the sheet receiver 7.

The sheet stack transported by the sheet receiver 7 is discharged into the discharge tray 10 through a stack discharge roller 9 shown in FIG. 1. At this time, the image-bearing side of the sheet stack discharged into the discharge tray 10 is inverted as compared with the posture that the sheets assumed when they were fed from the copying machine.

The discharge roller 9 and a guide member 60 for guiding the stack of sheets P to the discharge tray 10 are disposed above the endless belts 58. The discharge tray 10 is inclined upward toward a discharge direction for easy reception of the sheet stack stapled at one edge. The discharge tray 10 is fixed to an endless belt 61 vertically stretched. The discharge tray 10 is moved up and down by the endless belt 61 in accordance with the amount of the discharged sheets, while being guided by a guide mechanism not shown.

As described above, the finisher A1 according to this embodiment includes the deflector claws 5 which are located in the different positions corresponding to the lengths of the plurality of different types of sheets as measured with respect to the transportation direction. The sheet transportation path is changed by pivoting the deflector claws 5, so that a sheet can be fed into the intermediate tray from one of the positions corresponding to the length of the sheet. This arrangement obviates the need for providing a stapler driver and the like for prevention of the slip-in of the sheet. As a result, the apparatus has a smaller size and a simplified construction.

Next, an explanation will be given to cases where an A4 size sheet P is to be introduced into the intermediate tray 6 with and without the use of the bypass passage 51.

[Case not using Bypass Passage 51]

This corresponds to a case where no sheet P is currently retained in the intermediate tray 6, and sheets belonging to the same sheet set are to be successively transported into the intermediate tray 6.

The deflector claw 56 is located in the solid line position as seen in FIG. 2, and the sheets P successively introduced from the copying machine at the predetermined interval are sequentially transported in the direction of the arrow Y2 into the intermediate tray 6 through the transportation passage 50.

[Case using Bypass Passage 51]

This corresponds to a case where the stapling operation is currently performed on one set of sheets retained in the intermediate tray 6 so that the first sheet P1 of the next set of sheets successively fed from the copying machine at the predetermined time interval cannot be transported into the intermediate tray 6 at that time interval.

When the first sheet P1 of the next sheet set is to be introduced, the deflector claw 56 is initially located in the solid line position.

The first sheet P1 of the next sheet set passes over the transportation switch SW1 and, after a lapse of a predetermined time from detection of the trailing edge of the first sheet P1 of the next sheet set (or when the trailing edge of the first sheet just passes over the deflector claw 56), a clutch of the deflector roller pair 4*a*, which is transporting the sheet P1 within the transportation passage 50, is turned off (sheet stopping means). Thus, the sheet P1 is stopped within the transportation passage 50 in a state as shown in FIG. 2.

Then, the deflector claw 56 (sheet deflection means) is driven by a solenoid so as to be pivoted to the dot-and-dash line position. Thus, the second sheet P2 of the next sheet set is transported within the bypass passage 51 by the transportation roller 2.

Then, the second sheet P2 of the next sheet set passes over the transportation switch SW1 and, upon detection of the trailing edge of the second sheet P2 of the next sheet set, the clutch of the deflector roller pair 4a is turned on. Thus, the first and second sheets P1 and P2 are stacked and transported in the direction of the arrow Y3*d* into the intermediate tray 6 by the deflector roller pairs 4*c*, 4*d* (sheet feeding means).

In the finisher A1 of this embodiment, the first sheet P1 of the next sheet set is once stopped in the transportation passage 50 during the stapling operation performed on the one set of sheets previously supplied into the intermediate tray 6. Then, the second sheet P2 of the next sheet set is introduced into the bypass passage 51. Upon completion of the stapling operation performed on the one sheet set, the first and second sheets P1 and P2 of the next sheet set are stacked and supplied into the intermediate tray 6. Thus, the standby time for the processing of the next sheet set can be reduced with a simple and compact construction.

Although the embodiment described above is directed to the application of the sheet post-processing apparatus of the present invention to the finisher A1 for the copying machine, the present invention is not limited thereto. For example, the present invention is applicable to a sheet post-processing apparatus for any other image forming apparatuses such as printers.

In the embodiment described above, the stapler 8 is provided below the intermediate tray 6 but, instead, any other processing units such as a punching unit may be provided. Further, it is not always necessary to subject the sheets retained in the intermediate tray 6 to the stapling or punching operation, but the sheets may be subjected only to the sheet lateral edge aligning operation before being discharged. The sheet lateral edge aligning operation should also be regarded as one type of the sheet post-processing operation in the present invention.

Figure 6:
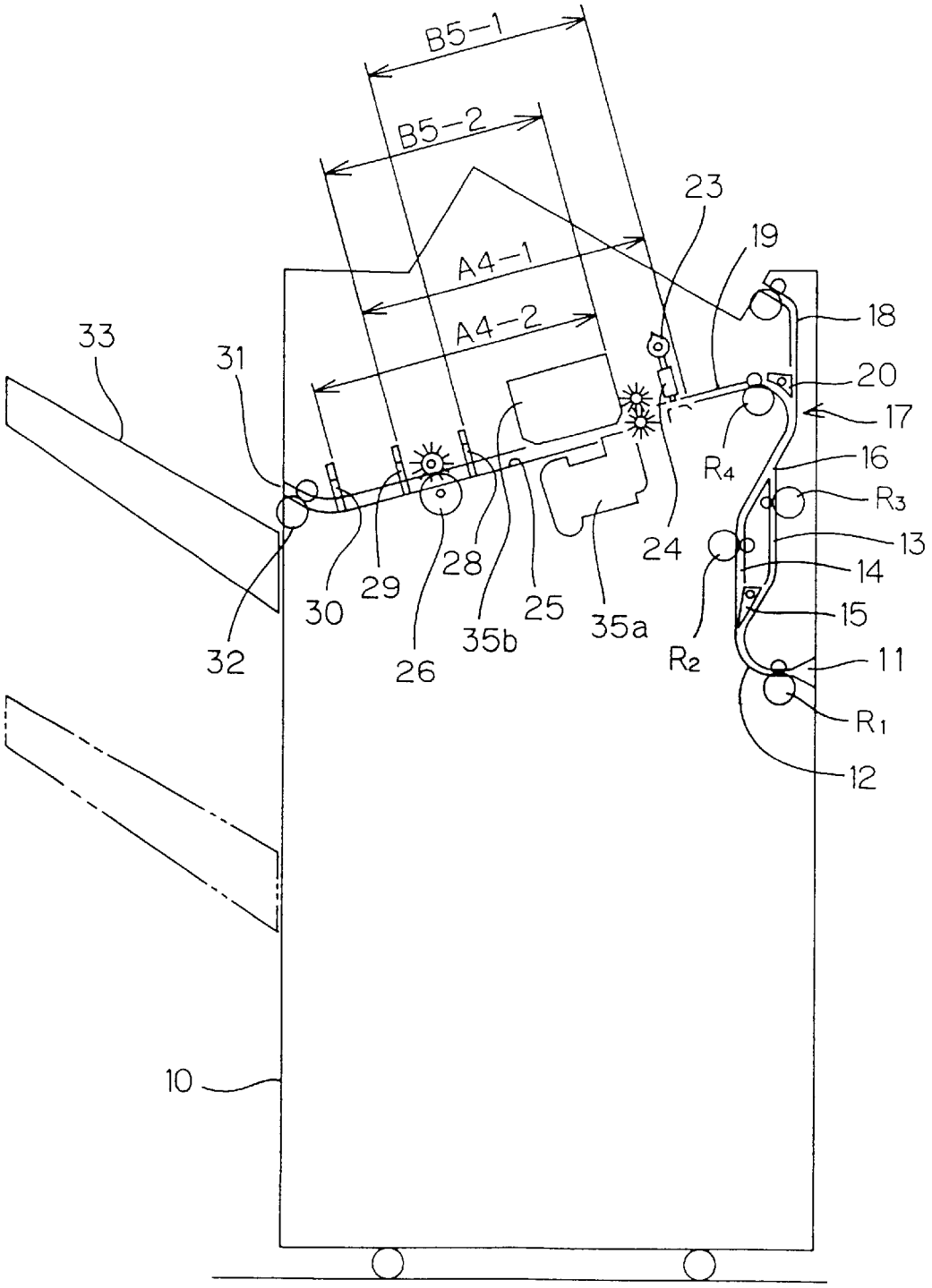
FIG. 6 is a sectional view schematically illustrating the construction of a finisher according to another embodiment of the present invention.
Figure 7:
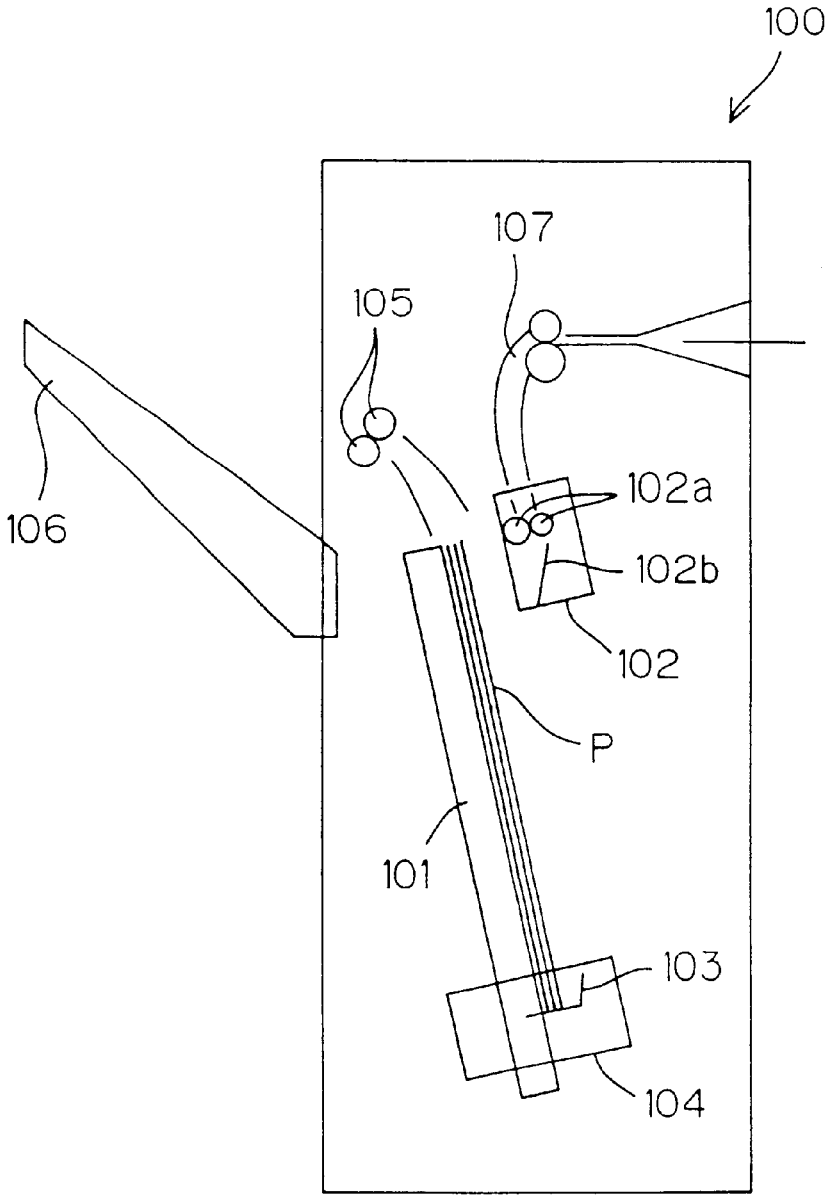
FIG. 7 PRIOR ART
FIG. 7 is a schematic view illustrating the construction of a conventional finisher.
Figure 8:
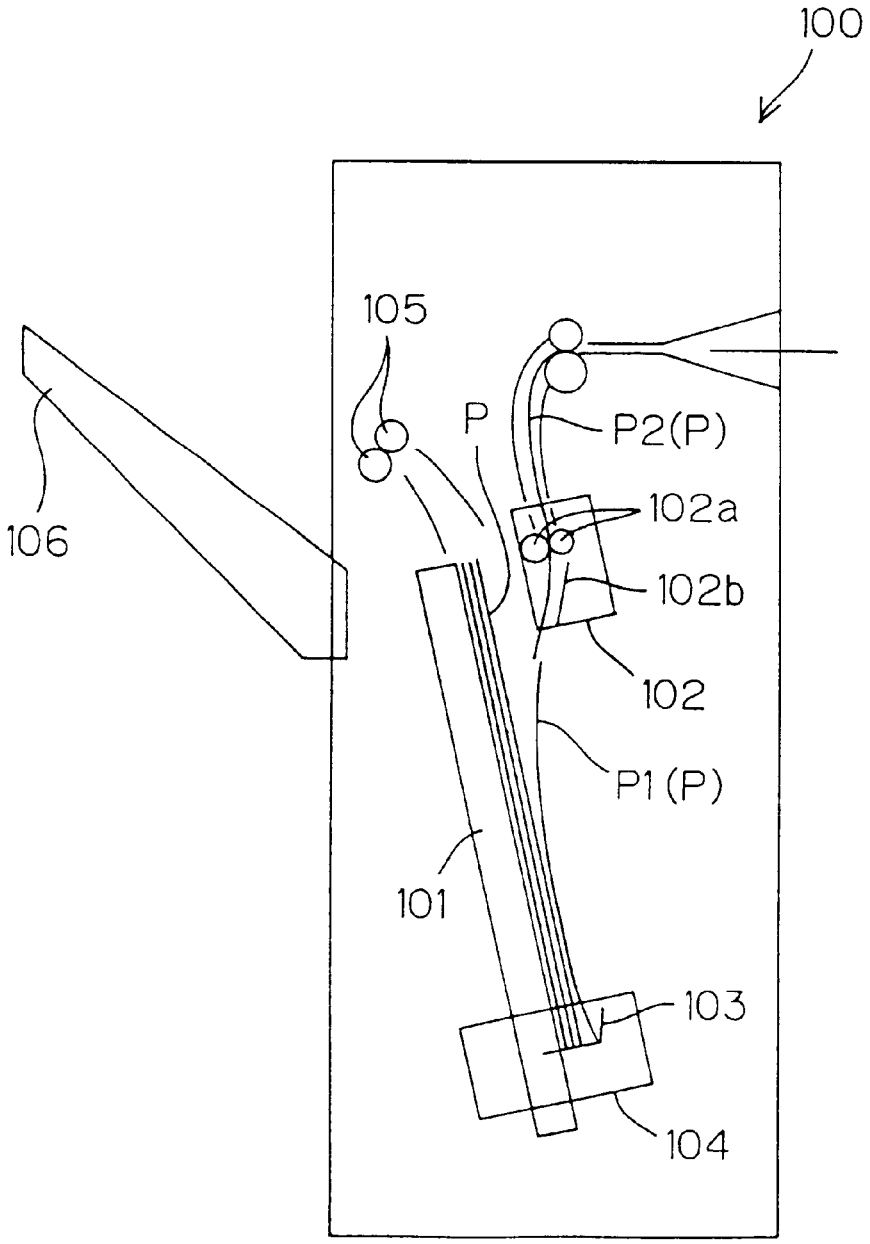
FIG. 8 PRIOR ART
FIG. 8 is a diagram for explaining slip-in of a sheet in the conventional finisher.

Besides the finisher A1 according to the embodiment described above, the present invention is applicable to another finisher A2 as shown in FIG. 6.

Referring to FIG. 6, an explanation will be given to the finisher A2.

The finisher A2 is designed to be connected to an image forming apparatus (not shown) provided on the right side thereof as seen in FIG. 6. Therefore, a sheet feeding port 11 for receiving a sheet subjected to the image forming operation and discharged from the image forming apparatus is provided on the right side of the finisher A2.

A transportation passage 12 connected to the sheet feeding port 11 is further connected to a transportation passage 13 and a bypass passage 14. A pivotal deflector claw 15 for switching a sheet transportation direction is provided at a branch point at which the transportation passage 12 is branched into the transportation passage 13 and the bypass passage 14. The transportation passage 13 and the bypass passage 14 are merged at a merge point 16, and branched again into transportation passages 18 and 19 at a branch point 17. A pivotal deflector claw 20 for switching between the transportation passages 18 and 19 is provided at the branch point 17. Reference characters R1, R2, R3, R4 denote transportation rollers provided in the respective transportation passages.

A plurality of punches 24 adapted to be reciprocally moved up and down (to be projected and retracted with respect to the transportation passage 19) by a cam 23 for punching are provided downstream portion of the lower transportation passage 19 as aligning perpendicularly to the plane of the drawing. A stapler 35 (35*a*, 35*b*) for stapling sheets placed on a sheet base 25 (corresponding to "intermediate tray") is provided further downstream portion of the transportation passage 19 with respect to the transportation direction. The sheets subjected to a post-processing operation by the punches 24 and/or the stapler 35 are discharged into a discharge tray 33.

The transportation roller R2 is provided with a clutch. Therefore, it is also possible that the sheet is once stopped within the bypass passage 14 and then discharged by turning on and off the transportation roller R2.

Thus, during the stapling operation performed on one set of sheets fed onto the sheet base 25 in the finisher A2, the second sheet of the next sheet set can be introduced into the transportation passage 13 with the first sheet of the next sheet set once stopped in the bypass passage 14. Upon completion of the stapling operation performed on the one sheet set, the first and second sheets of the next sheet set are stacked and fed onto the sheet base 25. As a result, the standby time for the processing of the next sheet set can be reduced with a simple and compact construction.

The finisher A2 is different from the finisher A1 in that the first sheet of the next sheet set is held on standby within the bypass passage 14.

The transportation passage in which the first sheet of the next sheet set is to be held on standby is determined so as not to change a sheet collating order in which sheets are fed into an intermediate tray.

While the present invention has been described in detail by way of the embodiments thereof, it should be understood that the foregoing disclosure is merely illustrative of the technical principles of the present invention but not limitative of the same. The spirit and scope of the present invention are to be limited only by the appended claims.

This application claims priority benefits under 35 USC 119 on the basis of Japanese Patent Applications No. 10-68859 and No. 10-68860 filed to the Japanese Patent Office on Mar. 18, 1998, the disclosure thereof being incorporated herein by reference.

What is claimed is:

1. A sheet post-processing apparatus, comprising:

a sheet tray capable of retaining therein a plurality of sheets;

a sheet transportation path for guiding a sheet into the sheet tray;

a bypass path bypassing at least part of the sheet transportation path for guiding a sheet into the sheet tray;

a post-processing mechanism for performing a predetermined post-processing operation on a set of sheets retained in the sheet tray; and a sheet transportation mechanism including: (a) sheet stopping means for, during the post-processing operation performed by the post-processing mechanism on one set of sheets previously fed into the sheet tray, once stopping a first sheet of a next sheet set in the transportation path, (b) sheet deflection means for transporting a second sheet of the next sheet set into the bypass path, and (c) sheet feeding means for feeding the first and second sheets of the next sheet set into the sheet tray upon completion of the post-processing operation performed on the one set of sheets previously fed into the sheet tray, wherein the bypass path extends to a location such that leading edges of the first and second sheets of the next sheet set are aligned at an outlet of the bypass path before the first and second sheets are fed by the sheet feeding means into the sheet tray.

2. A sheet post-processing apparatus as set forth in claim 1, further comprising a sheet feeding port for receiving sheets supplied thereto at a predetermined interval and guiding the sheets into the sheet transportation path.

3. A sheet post-processing apparatus as set forth in claim 1, wherein the sheet feeding means is adapted to stack the first and second sheets of the next sheet set and feed them into the sheet tray.

4. A sheet post-processing apparatus as set forth in claim 1, further comprising a sheet feeding port for receiving sheets and guiding the sheets into the sheet transportation path, wherein the bypass path is branched from the sheet transportation path at a branch point provided in the midst of the sheet transportation path.

5. A sheet post-processing apparatus as set forth in claim 4, wherein the sheet deflection means includes a pivotal deflector claw provided at the branch point.

6. A sheet post-processing apparatus as set forth in claim 1, wherein the post-processing mechanism is a stapling mechanism.

7. A sheet post-processing apparatus, comprising:

a sheet tray capable of retaining therein a plurality of sheets;

a sheet transportation path for guiding a sheet into the sheet tray, said sheet transportation path including a plurality of sheet feeding positions which are located at different distances which correspond to lengths of a plurality of different types of sheets as measured with respect to a sheet transportation direction;

a bypass path bypassing at least part of the sheet transportation path for guiding a sheet into the sheet tray;

a post-processing mechanism for performing a predetermined post-processing operation on a set of sheets retained in the sheet tray; and a sheet transportation mechanism including: (a) sheet stopping means for, during the post-processing operation performed by the post-processing mechanism on one set of sheets previously fed into the sheet tray, once stopping a first sheet of a next sheet set in one of the transportation path and the bypass path, (b) sheet deflection means for transporting a second sheet of the next sheet set into the other of the bypass path and the transportation path, and (c) sheet feeding means for feeding the first and second sheets of the next sheet set into the sheet tray upon completion of the post-processing operation performed on the one set of sheets previously fed into the sheet tray, wherein the sheet tray is in a plane parallel to a plane of the sheet transportation path, and the sheet transportation path is in a plane parallel to a plane of the bypass path.

8. A sheet post-processing apparatus, comprising:

a sheet tray capable of retaining therein a plurality of sheets;

a sheet transportation path for guiding a sheet into the sheet tray;

a bypass path bypassing at least part of the sheet transportation path for guiding a sheet into the sheet tray;

a post-processing mechanism for performing a predetermined post-processing operation on a set of sheets retained in the sheet tray; and a sheet transportation mechanism including: (a) sheet stopping means for, during the post-processing operation performed by the post-processing mechanism on one set of sheets previously fed into the sheet tray, once stopping a first sheet of a next sheet set in one of the transportation path and the bypass path, (b) sheet deflection means for transporting a second sheet of the next sheet set into the other of the bypass path and the transportation path, and (c) sheet feeding means for feeding the first and second sheets of the next sheet set into the sheet tray upon completion of the post-processing operation performed on the one set of sheets previously fed into the sheet tray, wherein the sheet tray is in a plane parallel to a plane of the sheet transportation path, and the sheet transportation path is in a plane parallel to a plane of the bypass path.

* * * * *